United States Patent [19]

Smith et al.

[11] Patent Number: 4,934,296

[45] Date of Patent: Jun. 19, 1990

[54] HYDROFOIL SAILBOAT AND METHOD OF SAILING THEREWITH

[76] Inventors: Bernard Smith, Rte. #1, Box 895, King George, Va. 22485; Ralph Gitomer, 1530 N. 12th St. #506, Arlington, Va. 22209-3604

[21] Appl. No.: 347,347

[22] Filed: May 3, 1989

[51] Int. Cl.[5] ..... B63H 9/04

[52] U.S. Cl. ..... 114/39.1; 114/126; 114/274

[58] Field of Search ..... 114/39.1, 90, 56, 102, 114/162, 61, 274, 280, 126

[56] References Cited

U.S. PATENT DOCUMENTS

| | | | |
|---|---|---|---|
| 3,094,961 | 6/1963 | Smith . | |
| 3,295,487 | 1/1967 | Smith | 114/39.1 |
| 3,473,502 | 10/1969 | Wittkamp | 114/61 |
| 3,631,828 | 1/1972 | Smith | 114/39.1 |
| 3,646,902 | 3/1972 | Smith | 114/39.1 |
| 3,883,909 | 5/1975 | Fisher et al. | 114/61 |
| 3,966,143 | 6/1976 | Smith | 114/39.1 |
| 3,981,258 | 9/1976 | Smith | 114/39.1 |
| 3,987,982 | 10/1976 | Amick | 114/39.1 |
| 4,008,677 | 2/1977 | Wordell, Sr. | 114/162 |
| 4,228,750 | 10/1980 | Smith et al. | 114/39.1 |
| 4,570,562 | 2/1986 | Dudouyt | 114/39.1 |
| 4,592,298 | 6/1986 | Finot | 114/39.1 |
| 4,674,427 | 6/1987 | Finot | 114/39.1 |
| 4,788,924 | 12/1988 | Hamel | 114/39.1 |

OTHER PUBLICATIONS

*New Approaches to Sailing*, Astronautics and Aeronautics Magazine, Mar. 1980, pp. 36–47.

*Primary Examiner*—Sherman D. Basinger
*Assistant Examiner*—Stephen P. Avila

[57] ABSTRACT

A tetrahedrally shaped pivotable sailing frame of four spars and a sail with balanced hydrofoils is disclosed. A hydrofoil sailboat is created by pivotally attaching the frame to a hull along a longitudinal axis of the hull. Tacking is accomplished by rotation of the frame about that axis. Although the sailing frame can be adapted to a variety of types of hulls, including windsurfers, catamarans, and multiple-hulled craft, a preferred embodiment of a hull is disclosed which in combination with the sailing frame affords the proper lift and forward vectors and obviates the need for a keel, live or dead ballast, or sail adjustments. The lift affords very high speeds and minimal wetted surface. The tetrahedral structure of the sailing frame is stiff, giving a level, stabilized ride and permitting an optimal surface area of sail. The hull design provides swift, easy tacking and reduces the possibility of backwinding.

15 Claims, 6 Drawing Sheets

Wind Direction
Direction of Motion
24a
24b
20
16
26
14
28a
28b
28c
28d
33a
33b
32a
32b
12
11
30
18
30°
15°

Wind Direction
Direction of Motion
10
24a
24b
20
22
14
16
26
12
11
28a
28d
33a
33b
32a
32b
30
31
18
15°
30°

FIG. 6
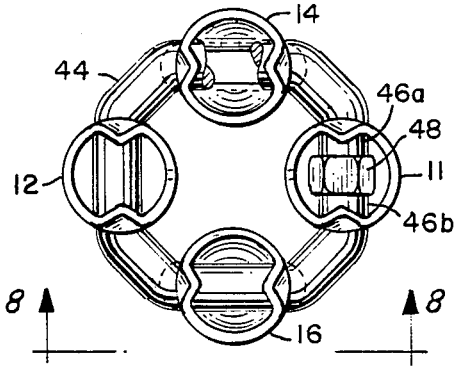
FIG. 7
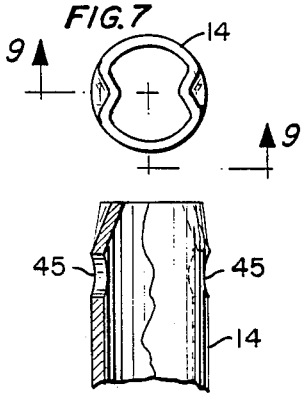
FIG. 9
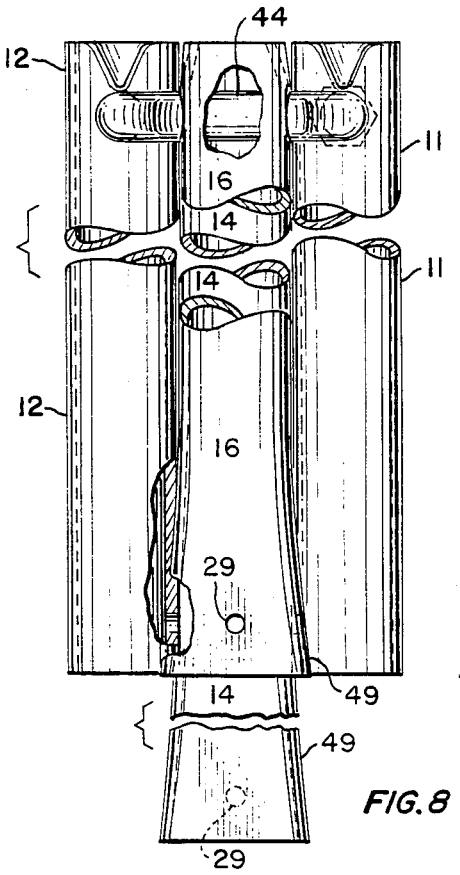
FIG. 8

HYDROFOIL SAILBOAT AND METHOD OF SAILING THEREWITH

BACKGROUND OF THE INVENTION

1. Field of the Invention

The invention relates generally to hydrofoil sailboats and more particularly to a novel sailing frame that greatly increases the speed and improves the balance and stability of such craft, and especially the ability to tack quickly and readily, in connection with which a novel hull and method of tacking are disclosed.

2. Description of the Related Art

The quest for a hydrofoil sailboat capable of attaining high speeds even in low winds with a shallow draft and carrying reasonably high payloads has been long lived. One of the milestones in this arduous quest was a book entitled "The 40-Knot Sailboat" written in 1963 by one of the present applicants and published by Grosset and Dunlop, New York, NY. To date, although several attempts have been made by the present applicants and numerous other skilled inventors to achieve all of these desirable operational capabilities, no single sailboat has been designed or built that has satisfied the necessary criteria.

Conventional monohull state-of-the-art sailboats suffer from the following limitations: they do not sail well at less than 30° to the true wind; they have a significant leeward vector above the center of gravity of the craft requiring a ballasted keel or moveable ballast which increases displacement and wetted surface area, thus increasing drag, and the ballast may produce a net negative buoyancy which reduces their safety; they are slow and difficult to tack under certain conditions; the maximum speed of a displacement vessel is constrained by wave drag and so cannot exceed hull speed, approximately 1.34 times the square root of the waterline length; and they sail at a greatly heeled angle in strong winds, creating among other difficulties insecure footing for people sailing them.

In the case of conventional windsurfers, the sail does not afford stabilization of the hull, making them difficult to sail in strong gusts. They are difficult to sail because of the balancing skills that must be learned and because they have no rudder. They are extremely limited in the sail area they can carry because live ballast is required.

The evolutionary steps made toward solving the above-noted operational problems and overcoming undesirable characteristics are shown in U.S. Pat. No. 3,094,961, issued Jan. 25, 1963; U.S. Pat. No. 3,295,487, issued Jan. 3, 1967; U.S. Pat. No. 3,631,828, issued Jan. 4, 1972; U.S. Pat. No. 3,646,902, issued Mar. 7, 1972; U.S. Pat. No. 3,981,258, issued Sept. 21, 1976; and in U.S. Pat. No. 4,228,750, issued Oct. 21, 1980. All of these patents were granted to Bernard Smith, one of the present applicants, and are hereby incorporated by reference herein.

The cited patents provide a discussion of the structure, dynamic forces, and controls of one particular variety of hydrofoil sailing frame. Although each of the aerohydrofoils and hydrofoil sailboats disclosed possessed certain desirable features, all suffered from one or more deficiencies that limited their commercial acceptance.

For example, the hydrofoil sailboat disclosed in U.S. Pat. No. 3,981,258 employs a slender hull with one flat side facing the foil-shaped sail and one convex side facing away from the sail. The sail is supported at its base ends by a pair of freely swiveling waterskis, and a ruddering hydrofoil is disposed at each end of the specially shaped hull. A crank is adjusted to take up or release the cables that position the ruddering hydrofoils, and the sail is inclined from the vertical to eliminate listing moments.

The hydrofoil sailboats patented by Smith prior to the sailboat shown in U.S. Pat. No. 3,981,258 suffered from one or more of the following defects: severely limited load-carrying capacity, unsatisfactory performance in low wind, and inordinate draft, making such craft unsuitable for shallow water or beaching operations. Although the waterski sailboat disclosed in U.S. Pat. No. 3,981,258 solved most of the problems encountered with the hydrofoil sailboats disclosed in the earlier Smith patents, its control system proved too cumbersome in strong winds, requiring excessive manual force and dexterity. Moreover, the hydrofoils attached to the bow and stern of the hull of the waterski sailboat could not be conveniently inclined to supply additional lift at high speed.

In U.S. Pat. No. 4,228,750 the craft described was difficult to sail, tack, and control in varying conditions. Also, the windward foil had a downward vector when it was backwinded, preventing tacking.

SUMMARY OF THE INVENTION

With the deficiencies of the previously known aerohydrofoils and hydrofoil sailboats clearly in mind, applicants have invented a hydrofoil windsurfer comprising a generally tetrahedral sailing frame in which the sail has spring-loaded hinged hydrofoils on opposite ends. The frame can be pivotally secured to either a conventional windsurfer-type hull or catamaran or to a novel hull of the invention. In sailing, the sail frame is tilted to leeward but the sail is inclined towards the wind and the hull. The sail is supported at a lower or leeward edge while sailing by either hydrofoil, the hinged connection of which permits the sail assembly to leave the water while tacking. The second hydrofoil at the other end of the sail acts as a stop which prevents air from passing over the end of the sail, reducing the sail tip vortex and increasing the effective length-to-width ratio of the sail and thus favorably increasing the lift-to-drag ratio. In tacking, the sail rotates over the hull in such a manner that the wind is always on the same side of the sail and the leading edge remains the same. A single tiller is situated at the aft end of the hull to steer the boat.

The sailing frame comprises, in addition to a sail member, four spars and four structural cables. The sail member, the four cables, and a longitudinal axis of the hull form the edges of a generally tetrahedral shape, with the four spars radiating from a central connector to the vertices of the tetrahedron. The four spars are prestressed in compression, and the compressive forces are pitted against tensile forces exerted by the structural cables, the hull, the sail member, and other components serving structural and other functions. The equilibrium of forces leads to a rigid but light frame with the notable advantage that each component stabilizes all the others to afford a remarkably smooth ride and the ability to loft an ideal surface area of sail. The sailing frame is joined to the hull by two swivel connections that allow the frame to rotate with respect to an axis passing through the connectors.

The sailing frame of the invention can be adapted for attachment to various types of hulls, but the preferred embodiment of hull disclosed best utilizes the sail design by reducing the angle needed to come about on the opposite tack. The time in which the sail heads into the wind with loss of driving force is thus reduced, and so is the probability of gaining sternway. The sailing frame may also be applied to catamarans and other multiple-hulled craft that have sufficient inertia to carry them through the larger turn angle needed to change tacks.

The disclosed arrangement affords the proper lift and forward vectors and obviates the need for a conventional keel, live or fixed ballast, or sail adjustments. The lift affords very high speeds and minimal wetted surface. The tetrahedral structure is stiff, giving a level, stabilized ride and permitting an optimal surface area of sail. The ideal ratio of sail area to wetted surface area is 780, since water has a density 780 times the density of air at sea level. The hull design provides swift, easy tacking and reduced the possibility of backwinding and/or making sternway. Maximum boat speed is obtained when the relative air speed is equal to the water speed. This is achieved in wind conditions that produce sufficient dynamic lift for reaching the ideal ratio of sail area to wetted area.

BRIEF DESCRIPTION OF THE DRAWINGS

The various objects, features, desirable attributes, and advantages of the hydrofoil sailboat of the present invention will become appararent in light of the following detailed description taken together with the accompanying drawings, in which:

FIG. 6 is a top view of the central connector in folded configuration;

FIG. 7 is a end view of a disassembled spar;

FIG. 8 is a side view with cutaway of the central connector and spars in folded configuration;

FIG. 9 is a side view, partly broken away, of the spar of FIG. 7.

DETAILED DESCRIPTION OF THE PREFERRED EMBODIMENTS

Figure 1:
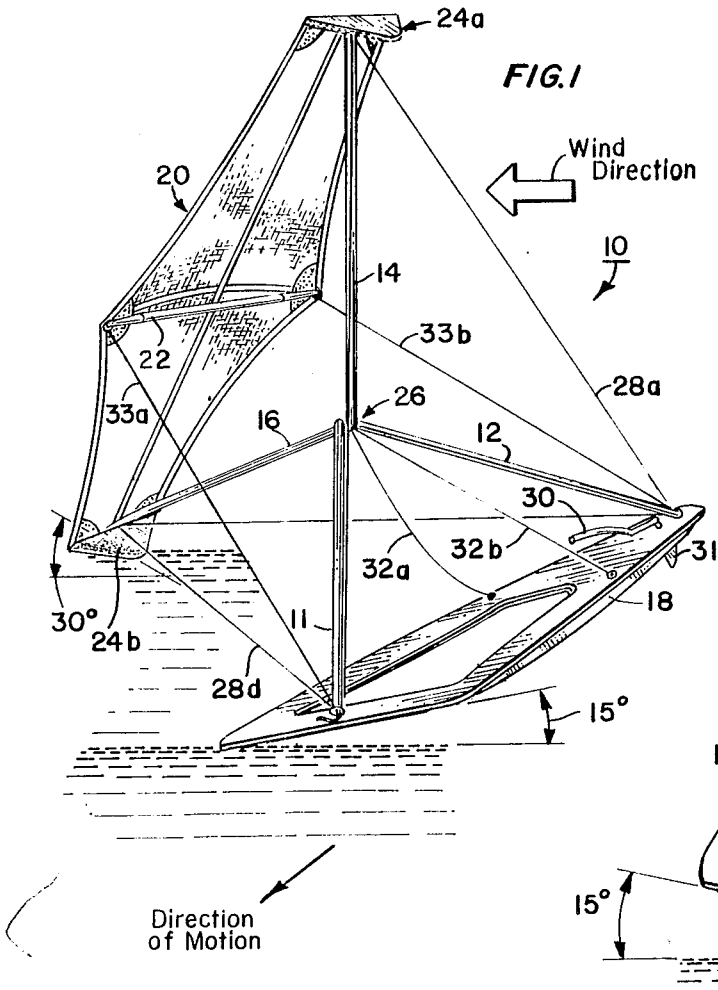
FIG. 1 is a perspective view of a hydrofoil sailboat in accordance with the principles of the invention on a port tack.

Referring in detail to FIG. 1, in which the invention is illustrated in simplified form, a hydrofoil sailboat 10 comprises a forward spar 11, an aft spar 12, first and second sail-connecting spars 14 and 16, a hull 18, a sail 20 with batten 22, a first hydrofoil 24*a*, a second hydrofoil 24*b*, a central connector 26, connecting cables 28*a*–28*d* (28*c* obscured from view), a tiller 30, a rudder 31, heeling ropes 32*a*, 32*b*, and sheeting lines 33*a*, 33*b*.

Figure 2:
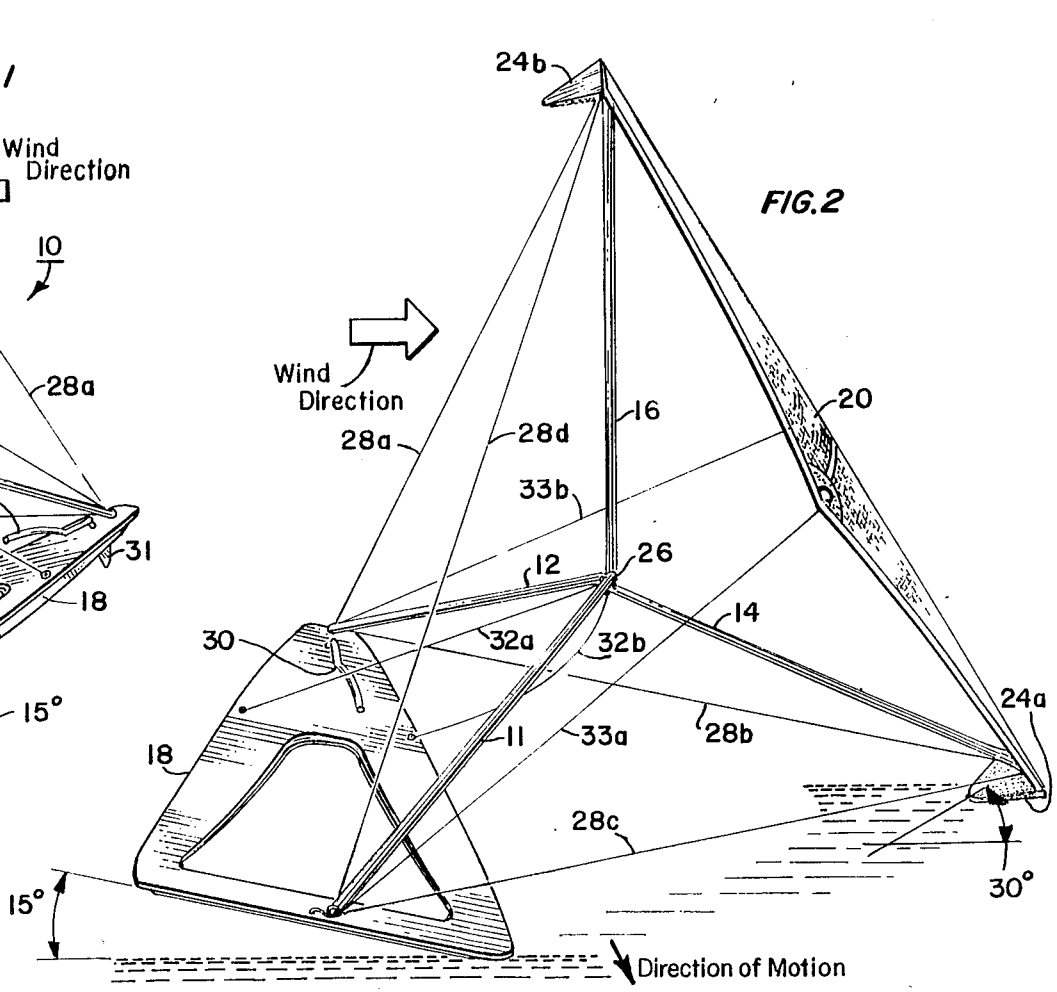
FIG. 2 is a perspective view of the sailboat of FIG. 1 on a starboard tack.

FIG. 2 illustrates hydrofoil sailboat 10 traveling on an opposite tack with respect to FIG. 1, and shows more clearly the connecting cables 28*a*–28*d*, in particular the cable 28*c* from spar 16 near hydrofoil 24*a* to the forward end of hull 18.

FIGS. 1 and 2 demonstrate the relative orientations of the various components of hydrofoil sailboat 10 while it is sailing. A unique feature of the invention is the manner in which the boat tacks. The side of the hull 18 toward the sail 20 is in contact with the water while the side of the hull 18 away from the sail 20 is lifted above the water by one of the heeling ropes 32*a* or 32*b* at approximately a 15° angle. This affords the advantages of less wetted surface area while underway, a surplus of flotation automatically utilized only when needed, and the lack of need for live ballast to stabilize the boat or sail assembly. When changing tacks, the boat is already turned 30° in the proper direction. As illustrated by the transition from FIG. 1 to FIG. 2, the entire sail assembly rolls over the hull 18, lifting the opposite side of the hull 18 by the heeling rope 32.

Spars 11, 12, 14, and 16 can be of round, elliptical, aerofoil or other cross-sectional shape. In a preferred embodiment they are tubes of a lightweight but strong aluminum alloy. Connecting cables 28*a*–28*d* can comprise wire ropes or ropes made of natural or synthetic fibers. Heeling ropes 32*a*, 32*b* and sheeting lines 33*a*, 33*b* can be made of any natural or synthetic fibers. The connection of a cable 28 to a spar is easily accomplished by drilling a hole 29 in the spar at the desired point of connection and passing an end of the cable through the hole and then knotting the end of the cable. Sail 20 is preferably made from 1.5-ounce ripstop nylon fabric, but can be made be made from other suitable materials such as dacron which are sufficiently strong and durable. Hull 18 can comprise a styrofoam core covered with layers of fiberglass coated with resin, or be made of any buoyant material, the exterior of which if necessary is treated to resist damage and provide impermeability to water.

Figure 3:
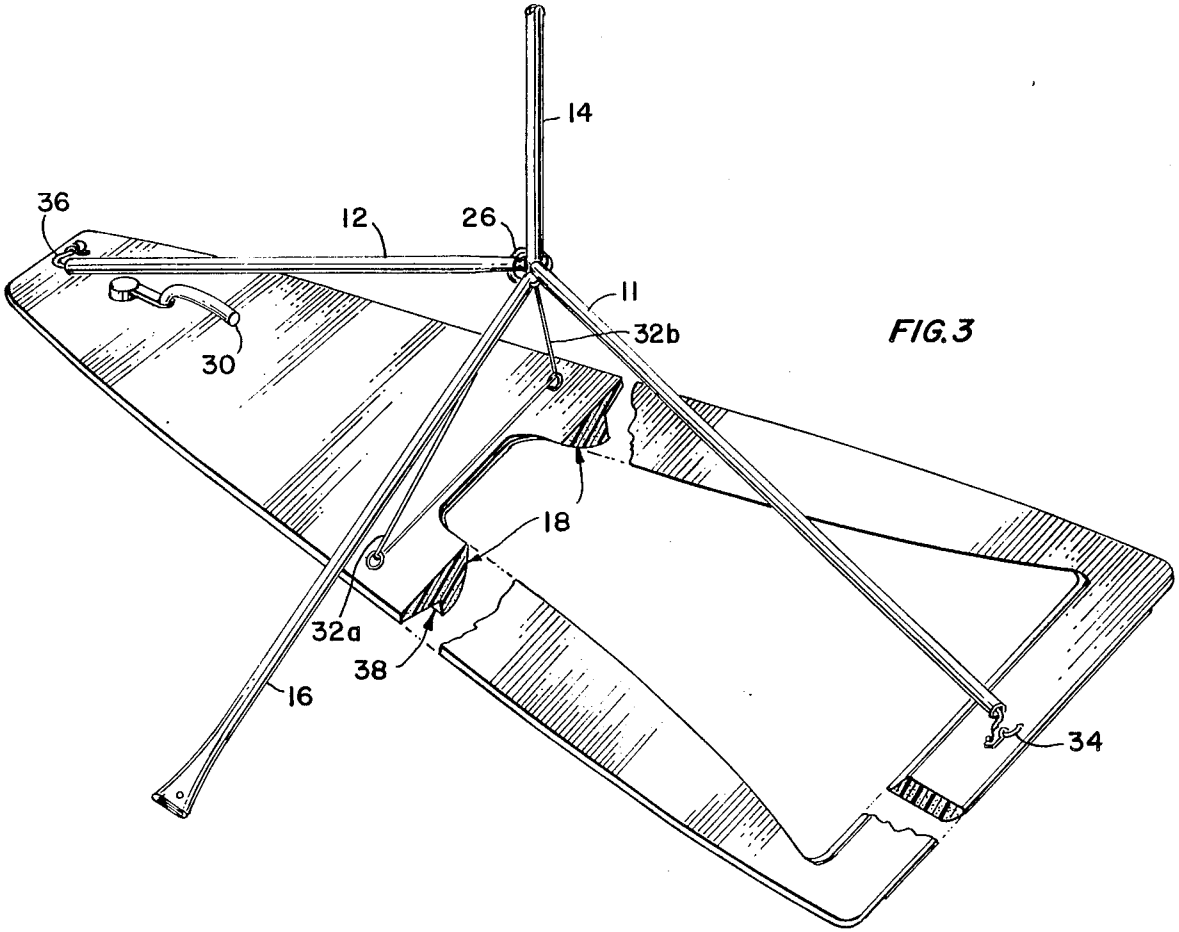
FIG. 3 is a fragmentary side elevation view of the sailboat of FIGS. 1 and 2 showing the hull and spars with cross-sectional views.

FIG. 3 illustrates two "S"-shaped hooks 34 and 36 holding the forward and aft spars 12 and 14, respectively, permitting them to swivel freely about a longitudinal axis 37 of hull 18 while sailboat 10 tacks. Any type of swivel connection will suffice, there being a number of simple alternatives. The cross-sectional view of hull 18 demonstrates centered keel rails 38*a* and 38*b*, which in effect eliminate the need for any other centerboard or other surface to prevent yawing and to track a bearing without increasing the depth of wetted surface required.

Figure 4:
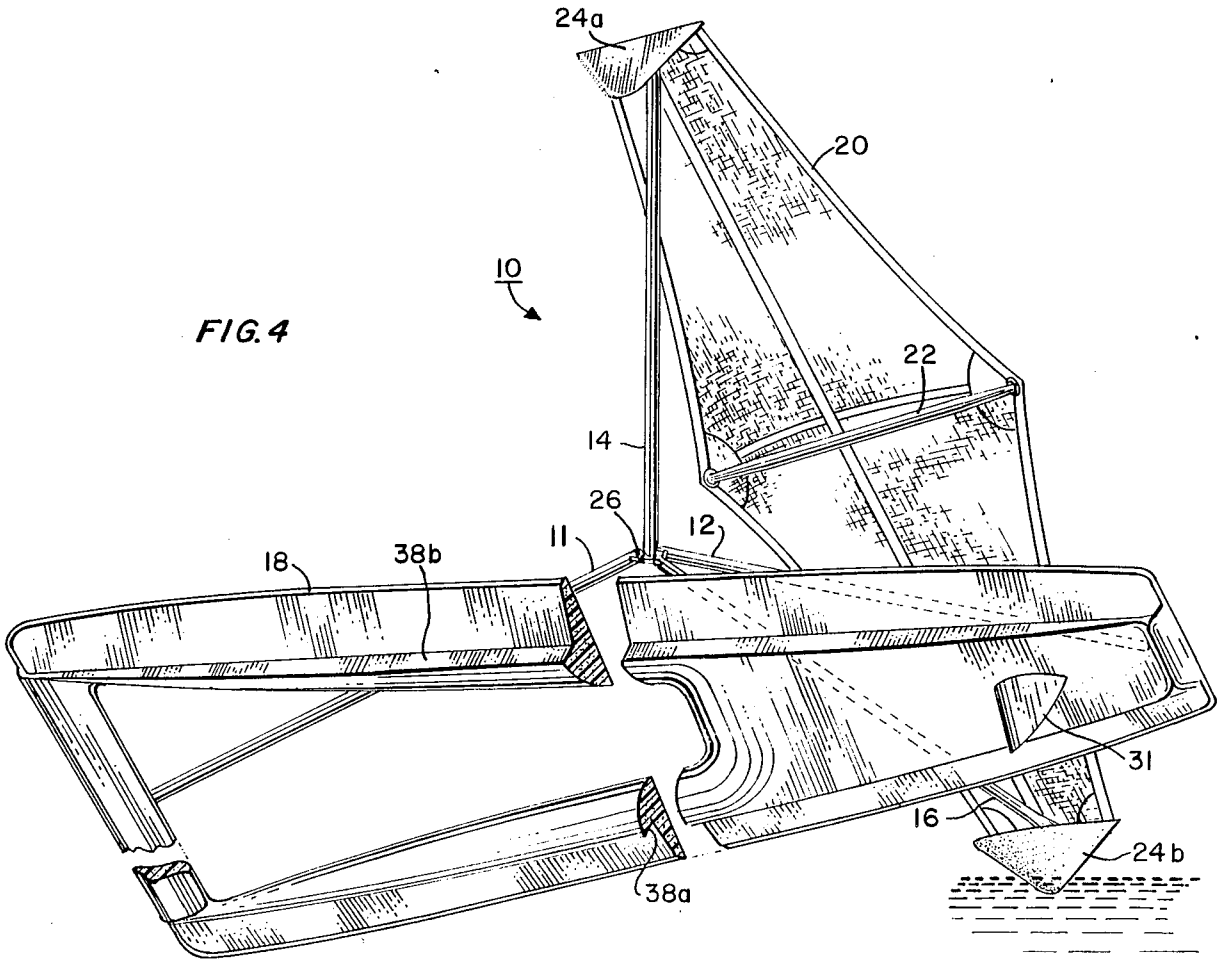
FIG. 4 is a fragmentary bottom elevation of the sailboat of FIGS. 1–3.

FIG. 4 further illustrates keels 38*a* and 38*b* symmetrically located with respect to longitudinal axis 37 of hull 18, a streamlined rudder 31, and a waterline 42 on the hydrofoil 24.

Figure 5:
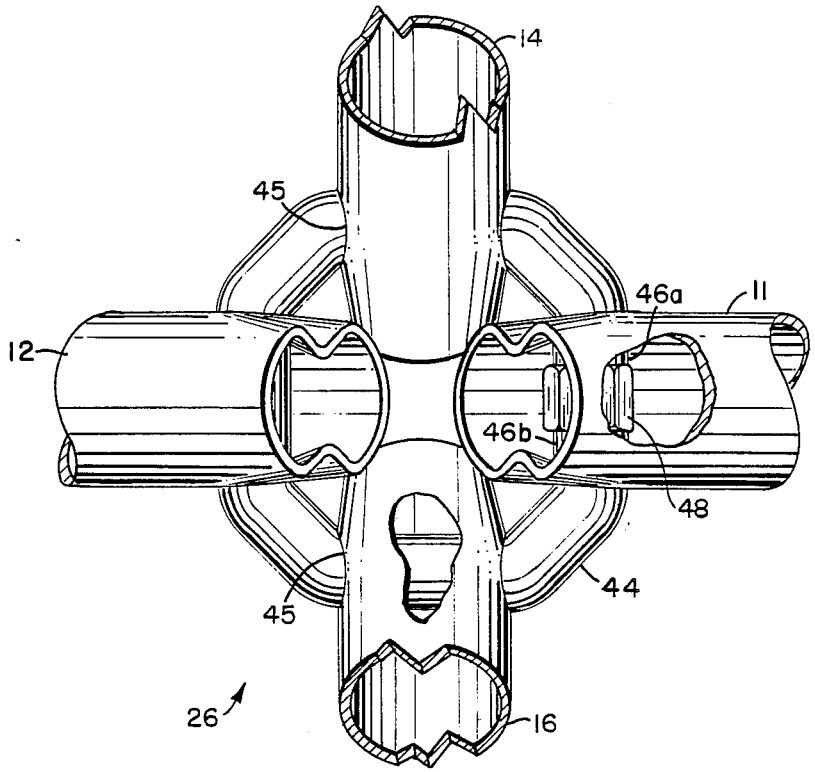
FIG. 5 is a detailed perspective view of the central connector with cutaway in operating configuration.

FIG. 5 illustrates the central connector 26 in detail. A rod or tube is formed into an octagonal ring 44, as for example by bending, and ring 44 passes through holes 45 in the walls of the tubular spars 11, 12, 14, and 16 near one end of each spar. The ends 46*a,b* of octagonal ring 44 are rigidly connected to each other by a hex nut 48 after the ends 46*a*, 46*b* have been threaded in opposite screw senses relative to each other. Bushings (not shown) may be optionally provided to reduce wear on octagonal ring 44 from the spars. The holes 45 in the spars are bent inward to permit easier insertion of the rod 44 through the holes 45 and to increase friction between the spars and ring 44 for increased stability in locking the frame into its sailing configuration.

FIG. 6 showns how the shape of the octagonal ring 44 rigidly holds the four spars 11, 12, 14, and 16 a set distance apart and does not permit them to slide over the rod 44 to contact each other. The spars 11, 12, 14, and 16 are held as close together as their movement permits without contact and with all components in compression.

FIG. 7 is an end view of a representative spar with a centered hole 45 through the midline at the connector end of the spar. FIG. 9 is a partly broken-away side view of the spar end shown in FIG. 7 FIG. 8 shows a side view demonstrating the flared end 49 of a spar connected to a hydrofoil 24*a* or 24*b*. This arrangement affords several possible types of hinge connectors to allow the sail to act as a spring and permit the hydrofoils 24*a*, 24*b* to hinge when the boat tacks.

Figure 10:
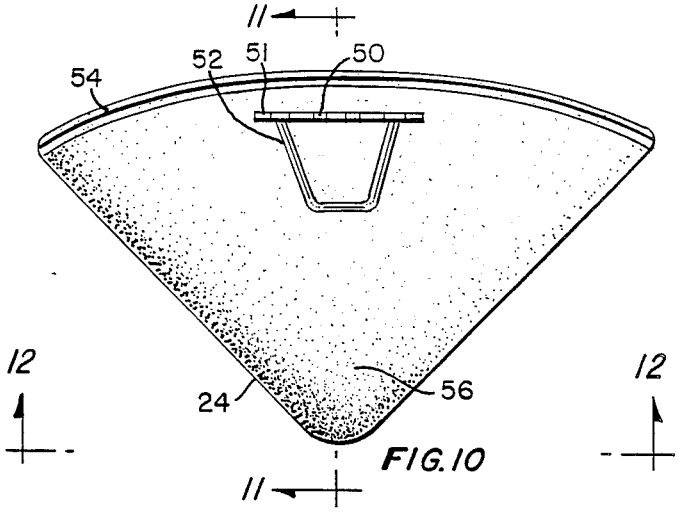
FIG. 10 is a top plan view of a disassembled hydrofoil and a hinge connection between a hydrofoil and sail-connecting spar.

FIG. 10 is a plan view of either of the hydrofoils 24*a*, 24*b*. Each is a mirror image of the other when assembled as part of the sailing frame. FIG. 10 illustrates one possible type of hinge connector on hydrofoil 24. A staple-shaped piece of metal has a straight portion 50 which is held in a hinge 51 attached to hydrofoil 24 and has a free tongue portion 52 which is inserted into the flared end 49 of a tubular sail-connecting spar spar 14 or 16 in a frictional fit. A groove 54 in hydrofoil 23 accommodates a bolt rope 64.

Figure 11:
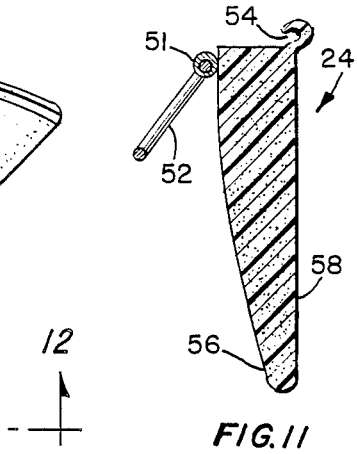
FIG. 11 is a cross-sectional view of the disassembled hydrofoil of FIG. 10.

FIG. 11 is a cross sectional view showing the shape of the hydrofoil 24. The side 56 over which water must travel faster in laminar flow is oriented toward the surface of the water in sailing. The opposite side 58 of the hydrofoil 24 is oriented toward deeper water in sailing. That is, either hydrofoil 24*a*, 24*b* is attached to the sail 20 in such an orientation that it provides in part an upward force on the end of the sail 20 when in the water and moving through it. Hydrofoils 24*a*, 24*b* can be made from any suitable material such as plastic, wood, or composite materials. A flexible hinge member can be formed in a hydrofoil at the time the hydrofoil is made in the case where the hydrofoil is made of a plastic material.

The hydrofoil 24 provides static flotation supporting the sail assembly at rest, and hydrodynamic lift with the least resistance while underway. Additionally, when the hydrofoil 24 is out of the water it acts as an air stop at the end of the sail 20, reducing the vortex and therefore giving the effect of a sail that acts as if it were longer than it really is, which increases its lift-to-drag ratio.

Figure 12:
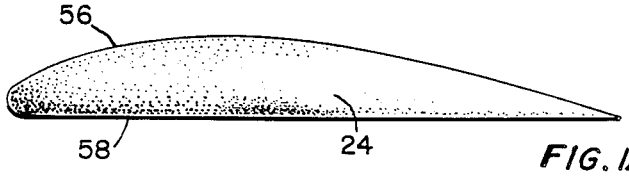
FIG. 12 is an end view of the disassembled hydrofoil of FIG. 10.

FIG. 12 further demonstrates the shape of the hydrofoil 24. The rudder 31 is of similar shape but symmetrically curved on both sides to afford minimum resistance in moving through the water.

Figure 13:
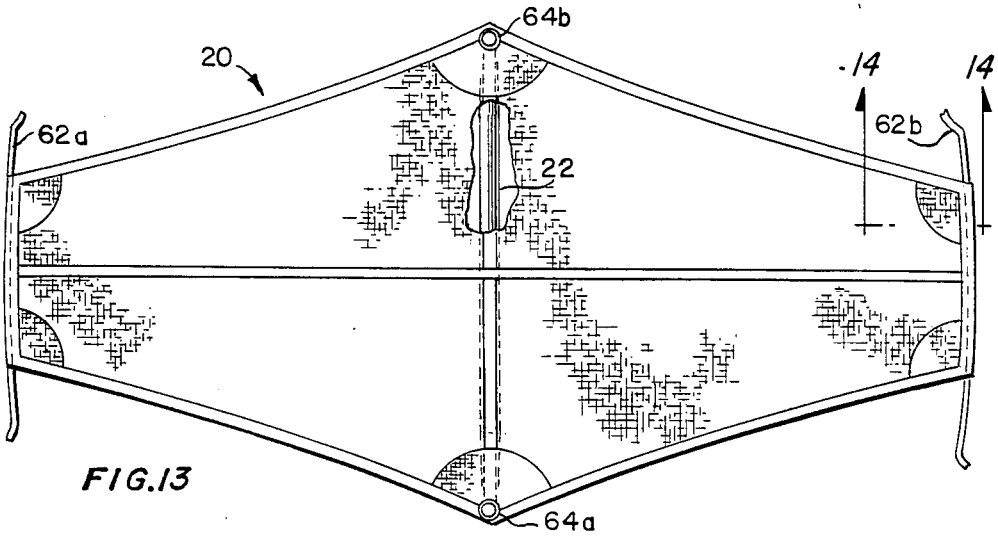
FIG. 13 is a top plan view of the sail.

FIG. 13 shows the sail 20 with the bolt ropes 62*a*, 62*b* at the two ends. The batten 22 is attached to two grommets 64*a*, 64*b* to maintain a rigid structure for the sail 20. This rigidity increases sail efficiency and dampens the motion of hull 18. Sail 20 is stretched along its length with about 150 pounds of tension in assembling the tetrahedral structure of the sailing frame. In setting up the frame, connecting cables are tightened, as for example with a small winch or a cable ratchet. Sheeting lines 33*a* and 33*b* are attached to sail 20 through grommets 64*a*, 64*b* and to forward and aft spars 11 and 12 at their ends nearest hull 18.

Figure 14:
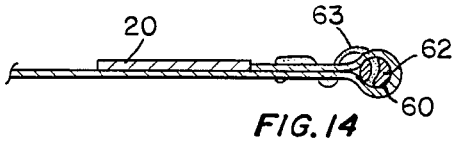
FIG. 14 is a cross-sectional view of that part of the sail indicated in FIG. 13.

FIG. 14 is a cross sectional view of part of the sail 20 as indicated in FIG. 13. Bolt rope 62 is sewn into a slot 60 formed by folding the end of sail 20 over and sewing or gluing the folded end onto the main body of the sail. FIG. 14 illustrates the end reinforcement of the sail 20 and how bolt rope 62 is sewn into the sail 20 to hold it tighly. Slot 60 for the bolt rope 62 of the sail 20 affords an airtight seal between the sail 20 and hydrofoil 24. An end of the sail where a hydrofoil is connected has sewn into it with thread 63 a ¼-inch rope bolt rope 62. The extended ends of bolt ropes 62*a* and 62*b* are for convenience in pulling a bolt rope 62 in or out of a hydrofoil groove 54; they remain in place when the sail is in tension.

Some typical dimensions for a hydrofoil sailboat 10 are as follows for a hull 18 which is 18 feet long: sail 20 is 20.5 feet long in its span, 12 feet wide at its middle and 4.5 feet wide at its ends; spars 11, 12, 14, and 16 are each 12 feet long; and connecting cables 28 are each 19 feet, 9 inches long.

A hydrofoil sailboat 10 in accordance with the invention described above that has been built with the novel hull disclosed or with a conventional hull to which the novel sailing frame disclosed has been later retrofitted operates generally as follows:

The sail 20, when fully raised, is tilted at an angle of about 30° to the vertical. Hydrofoil is at about 90° to sail 20. Either hydrofoil 24*a* or 24*b* supports sail 20, utilizing the tension in sail 20 as a spring to permit it to hinge but be metastable in either position requiring only one moving part, itself. The central connector 26 allows spars 11, 12, 14, and 16 to be held rigidly in a correct positional angle for sailing. Alternatively, connector 26 allows spars 11, 12, 14, and 16 to be folded loosely for convenience in disassembling the hydrofoil sailboat 10. There is no need for tools to change from one configuration to the other.

The sail member 20 is fixed in regard to its angle with the vertical, but may be sheeted rotationally with respect to a vertical axis of rotation to vary its angle of attack to the wind. Because the speed of the boat is far in excess of the actual wind speed, the apparent angle of attack of the wind remains within 15°.

In tacking, the sail 20 rotates over the hull 18. The rotation is with respect to the longitudinal axis 37. The hull 18 changes effective bearing by a rolling and yawing action as the boat tacks. The sail 20 acts not only as a structural member of the boat 10, but also as a propulsive wing, and as a spring acting on one of the hydrofoils 24*a* or 24*b*, supporting it; this reduces backwinding and makes the boat easier to tack.

The use of a hull such as 18 which is not especially designed for sailing (in the conventional sense) is not only feasible but desirable because the listing forces normally imposed upon conventional sailboats are cancelled out by counterbalancing moments in the present invention. Also, a planing hull has different design features than a conventional sailboat hull.

The hull 18 could be articulated by a longitudinal hinge or by a scissorstype mechanism in combination with locking structural members to create an easily folded, compact, collapsible hull for easy transport. The sailing frame can be attached to any hull with any type of connectors that allows rotation of the frame from one side of the hull to the other in a manner that allows tacking to be effected.

The above-described embodiments are furnished as illustrative of the principles of the invention, and are not intended to define the only embodiments possible in accordance with our teaching. Rather, the invention is to be considered as encompassing not only the specific embodiments shown, but also any others falling within the scope of the following claims.

We claim:

1. A sailing frame for connection to a hull having part and starboard sides for a means of supporting a sail member comprising:

first and second hydrofoil means on said sail member for providing hydrofoil forces thereon;

pivoting means for allowing said sail member to rotate from a first orientation in which said first hydrofoil means is off said port side of said hull into a second orientation in which said second hydrofoil means is off said starboard side of said hull and vice versa;

first and second sail-connecting spar means, and forward and aft spar means for maintaining a generally tetrahedral shape of said frame;

spar connector means for connecting together first ends of each said spar means;

first connector means for connecting a second end of said first sail-connecting spar means to a second end of said aft spar means;

second connector means for connecting a second end of said second sail-connecting spar means to a second end of said forward spar means;

third connector means for connecting a second end of said aft spar means to a second end of said second sail-connecting spar means; and fourth connector means for connecting a second end of said forward spar means to a second end of said second sail-connecting spar means;

wherein said sail member is connected between said second ends of said first and second sail-connecting spar means.

2. The sailing frame of claim 1 wherein said sailing frame is generally in the shape of a tetrahedron, with said sail member forming one edge thereof.

3. The sailing frame of claim 1 wherein said spar connector means is pivotally connected to said first end of each said spar means so that said frame can either be folded into a collection of parallel spars for storage and transportation or set up and locked into said generally tetrahedral shape for sailing.

4. The sailing frame of claim 3 wherein said spar connector means comprises a generally octagonal ring passing through holes in said first ends of said first and second sail-connecting spar means, said aft spar means, and said forward spar means.

5. The sailing frame of claim 4 wherein said generally octagonal ring comprises a rod with first and second ends threaded in reverse screw sense and connected to each other by screwing into opposite ends of a tapped hole in a connecting member.

6. The sailing frame of claim 1 wherein said sail member further comprises a batten or boom means for maintaining a general shape of said sail member, connected between third and fourth edges thereof.

7. The sailing frame of claim 6 wherein said batten means comprises a substantially rigid, elongated member with first and second ends fitting into first and second grommets in said third and fourth edges of said sail member, respectively.

8. A hydrofoil sailboat for sailing in a wind, comprising: a hull;

first, second, third, and fourth spars, each having first and second ends;

a sail member connecting said second ends of said first and second spars;

a first hydrofoil member hinged to said sail member and having an orientation such that lift is provided to said sail member when said first hydrofoil member is moving through water;

a second hydrofoil member hinged to said sail member at an opposite edge thereof and having an orientation such that lift is provided to said sail member when said second hydrofoil member is moving through water;

a first connecting means for connecting said first ends of said spars at one location from which said spars radiate;

a second connecting means for pivotally connecting said second ends of said first and second spars to said hull; and a third connecting means for connecting said second ends of said third and fourth spars to said sail member;

steering means attached to said hull for steering said sailboat with a rudder attached to said hull; and sheeting means attached to said sail member for sheeting said sail member to change its angle of attack on the wind.

9. The hydrofoil sailboat of claim 8 wherein said first connecting means comprises means for allowing said spars to be folded loosely or to be held rigidly in a generally tetrahedral configuration without the use of any tools.

10. The sailboat hull of claim 8 wherein said hull is generally in the shape of an isosceles triangle, with said forward end being one side of said triangle and said aft end being a vertex of said triangle opposite said one side.

11. The hydrofoil sailboat of claim 8 wherein said hull further comprises a longitudinal hinge and locking structural members so that said hull can be folded into a compact shape for easier transport.

12. The hydrofoil sailboat of claim 8 wherein said hull further comprises a scissors shape with a pivot member and with locking structural members so that said hull can be collapsed via a scissors-type action into a compact shape for easier transport.

13. The hydrofoil sailboat of claim 8 wherein said spars are aerofoil in cross section.

14. The hydrofoil sailboat of claim 8 wherein said hull further comprises hull alignment means to automatically align said hull rotationally when said boat tacks.

15. The method of sailing of claim 8 wherein said hydrofoil supports said sail member, is prestressed in tension, and said hydrofoil utilizes tension in said sail member as a spring to permit it to hinge but be metastable in either tacking position.

* * * * *